US009206818B2

(12) United States Patent
Nakayama et al.

(10) Patent No.: US 9,206,818 B2
(45) Date of Patent: Dec. 8, 2015

(54) AXIAL FLOW COMPRESSOR

(75) Inventors: Yoshihiro Nakayama, Takasago (JP); Yoshitaka Baba, Takasago (JP); Satoshi Ide, Takasago (JP); Koichiro Iizuka, Takasago (JP); Ryo Fujisawa, Kobe (JP); Masatake Toshima, Kobe (JP); Kunihiko Suto, Chiyoda-ku (JP); Kazutaka Kurashige, Chiyoda-ku (JP); Hiroshi Egawa, Chiyoda-ku (JP); Ichirou Sakuraba, Nagoya (JP); Daisuke Hayashi, Nagoya (JP); Keiji Sugano, Amagasaki (JP); Svend Rasmussen, Bjerringbro (DK); Ziad Al-Janabi, Hadsten (DK); Finn Jensen, Taastrup (DK); Lars Bay Moller, Aarhus V (DK); Hans Madsboll, Taastrup (DK); Christian Svarregaard-Jensen, Skanderborg (DK); Klaus Damgaard Kristensen, Hojbjerg (DK)

(73) Assignees: Tokyo Electric Power Company, Incorporated, Tokyo (JP); Chuba Electric Power Company, Incorporated, Nagoya-shi (JP); THE KANSAI ELECTRIC POWER CO., INC., Osaka-shi (JP); KABUSHIKI KAISHA KOBE SEIKO SHO, Kobe-shi (JP); DANISH TECHNOLOGICAL INSTITUTE, Taastrup (DK); JOHNSON CONTROLS DENMARK APS, Hojbjerg (DK)

( * ) Notice: Subject to any disclaimer, the term of this patent is extended or adjusted under 35 U.S.C. 154(b) by 622 days.

(21) Appl. No.: 13/635,518

(22) PCT Filed: Mar. 15, 2011

(86) PCT No.: PCT/JP2011/001513
§ 371 (c)(1),
(2), (4) Date: Sep. 17, 2012

(87) PCT Pub. No.: WO2011/114716
PCT Pub. Date: Sep. 22, 2011

(65) Prior Publication Data
US 2013/0011280 A1 Jan. 10, 2013

(30) Foreign Application Priority Data
Mar. 17, 2010 (JP) ..... 2010-060580

(51) Int. Cl.

| | |
|---|---|
| ***F04D 29/54*** | (2006.01) |
| ***F04D 19/02*** | (2006.01) |
| ***F04D 29/66*** | (2006.01) |
| ***F04D 25/06*** | (2006.01) |
| ***F04D 29/053*** | (2006.01) |
| ***F04D 29/56*** | (2006.01) |

(52) U.S. Cl.
CPC ..... *F04D 29/541* (2013.01); *F04D 19/02* (2013.01); *F04D 25/0606* (2013.01); *F04D 29/053* (2013.01); *F04D 29/563* (2013.01); *F04D 29/668* (2013.01)

(58) Field of Classification Search
CPC ..... F04D 19/04; F04D 19/042; F04D 29/04; F04D 29/043; F04D 29/053; F04D 29/054; F04D 25/022; F04D 3/00; F04D 19/00; F04D 29/044; F04D 29/05; F04D 29/321; F04D 29/441; F04D 29/52; F01D 5/02; F25D 39/04; F04B 35/04
See application file for complete search history.

(56) References Cited

U.S. PATENT DOCUMENTS

| | | | | |
|---|---|---|---|---|
| 4,120,175 | A * | 10/1978 | Dernedde | 464/93 |
| 4,342,201 | A | 8/1982 | Ishii | |
| 5,755,554 | A * | 5/1998 | Ryall | 415/199.4 |
| 6,379,110 | B1 | 4/2002 | McCormick et al. | |
| 2004/0184914 | A1 | 9/2004 | Doege et al. | |
| 2007/0039330 | A1 * | 2/2007 | Bladon et al. | 60/785 |
| 2009/0193840 | A1 | 8/2009 | Kurihara et al. | |

FOREIGN PATENT DOCUMENTS

| | | | |
|---|---|---|---|
| CN | 201129311 | Y | 10/2008 |
| JP | 46-36402 | | 10/1971 |
| JP | 49 33409 | | 3/1974 |
| JP | 50-34323 | Y | 10/1975 |
| JP | 53-110108 | A | 9/1978 |
| JP | 56 99010 | | 8/1981 |
| JP | 56 111218 | | 8/1981 |
| JP | 56-115896 | A | 9/1981 |
| JP | 62-210295 | A | 9/1987 |
| JP | 2002 5092 | | 1/2002 |
| JP | 2002 537184 | | 11/2002 |
| JP | 2002-371988 | A | 12/2002 |
| JP | 2005-120926 | A | 5/2005 |
| JP | 2005 290987 | | 10/2005 |
| JP | 2009-185715 | A | 8/2009 |

OTHER PUBLICATIONS

Combined Office Action and Search Report issued Sep. 26, 2014 in Chinese Patent Application No. 201180014288.2 with English Summary and English Translation of Category of Cited Documents.

Office Action issued Jan. 6. 2015 in Japanese Application No. 2010-060580 (with English summary).

International Preliminary Report on Patentability Issued Oct. 23, 2012 in PCT/JP11/001513 Filed Mar. 15, 2011.

International Search Report Issued Jun. 14, 2011 in PCT/JP11/01513 Filed Mar. 15, 2011.

* cited by examiner

*Primary Examiner* — Richard Edgar
(74) *Attorney, Agent, or Firm* — Oblon, McClelland, Maier & Neustadt, L.L.P

(57) ABSTRACT

An axial flow compressor includes: an electric motor including a rotating shaft; a compression portion including a driving shaft connected without a speed-up gear to the rotating shaft of the electric motor and a rotor rotating together with the driving shaft, the compression portion driving the driving shaft and thereby compressing a working fluid; and a velocity reducing portion having a space for reducing the flow velocity of a working fluid discharged from a discharge opening of the compression portion. The rotating shaft of the electric motor is connected to the end of the driving shaft on the side of the discharge opening; and the velocity reducing portion is disposed so as to surround the electric motor.

4 Claims, 1 Drawing Sheet

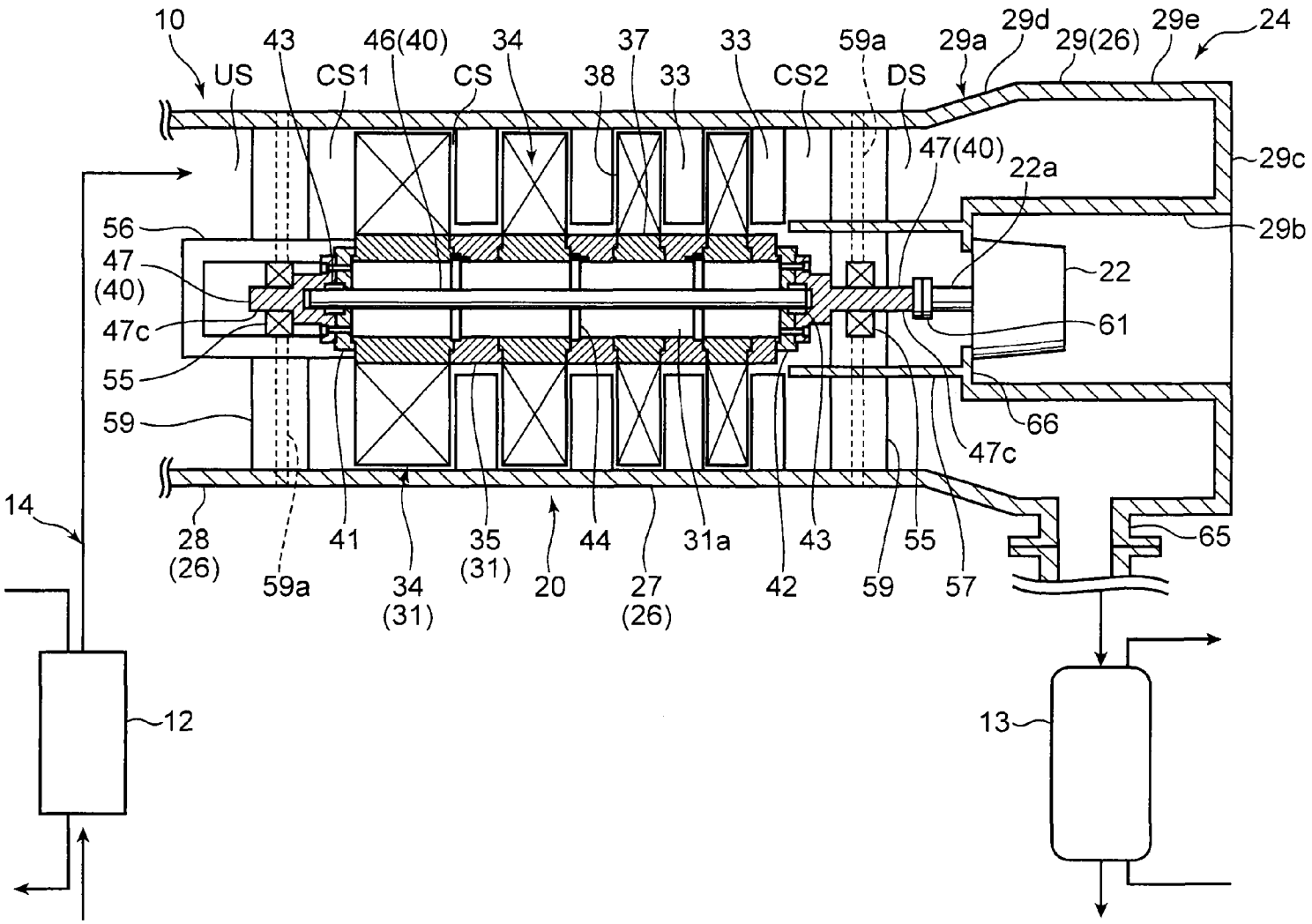
24
29c
29b
29e
29(26)
29d
29a
DS
59a
CS2
33
33
37
38
34
CS
46(40)
CS1
43
US
10
56
47
(40)
47c
55
59
14
12
28
(26)
59a
41
34
(31)
35
(31)
20
44
27
(26)
31a
42
43
59
55
57
47c
47(40)
22a
22
61
66
65
13

AXIAL FLOW COMPRESSOR

TECHNICAL FIELD

The present invention relates to an axial flow compressor.

BACKGROUND ART

Conventionally, a compressor provided with a speed-up mechanism is known as disclosed in the following Patent Document 1. Using the speed-up mechanism arranged between the driving shaft of an electric motor and the main shaft of a compression portion, the compressor is capable of driving the compression portion at a higher rotational speed than the electric motor while lowering the rotational speed of the electric motor. The compression portion includes a diffuser extending in the radial directions which reduces the flow velocity of a working fluid accelerated and pressurized by an impeller of the compression portion, and thereby, the compressor discharges the working fluid at a predetermined velocity reduced by the diffuser.

The compressor disclosed in the following Patent Document 1 cannot be miniaturized beyond a certain limit. Specifically, the speed-up mechanism provided for the compressor requires that a first gear provided in the rotating shaft of the electric motor should have a larger diameter to thereby rotate the main shaft of the compression portion at a higher speed than the driving shaft of the electric motor and also requires that the electric motor should be arranged offset against the compression portion to thereby engage the first gear and a second gear provided in the main shaft of the compression portion. This enlarges the width of the compression portion in the diametrical directions and hence sets limits to miniaturization of the compressor or particularly an axial flow compressor. Besides, the diffuser provided in the compression portion extends in the diametrical directions with respect to the impeller, thereby enlarging the width of the compression portion in the diametrical directions.

LIST OF PRIOR ART DOCUMENTS

Patent Documents

Patent Document 1: Japanese Patent Laid-Open Publication No. 2002-5092

SUMMARY OF THE INVENTION

It is an object of the present invention to solve the mentioned problem.

It is an object of the present invention to provide an axial flow compressor capable of reducing the flow velocity of a working fluid discharged from a compression portion to a predetermined value and being miniaturized.

An axial flow compressor according to the present invention for compressing a working fluid includes: an electric motor including a rotating shaft; a compression portion including a driving shaft connected without a speed-up gear to the rotating shaft of the electric motor and a rotor rotating together with the driving shaft, the compression portion driving the driving shaft and thereby compressing a working fluid; and a velocity reducing portion having a space for reducing the flow velocity of a working fluid discharged from a discharge opening of the compression portion, in which: the rotating shaft of the electric motor is connected to the end of the driving shaft on the side of the discharge opening; and the velocity reducing portion is disposed so as to surround the electric motor.

BRIEF DESCRIPTION OF THE DRAWINGS

FIG. 1 is a schematic view showing a configuration of an axial flow compressor according to an embodiment of the present invention.

DESCRIPTION OF EMBODIMENTS

An embodiment of the present invention will be below described in detail with reference to the drawing.

As shown in FIG. 1, an axial flow compressor 10 according to the embodiment is a compressor for a refrigerator and provided on a refrigerant circuit 14 including an evaporator 12 and a condenser 13. The axial flow compressor 10 compresses water vapor as a working fluid (refrigerant) evaporated in the evaporator 12. The water vapor is a relatively low-temperature and low-pressure vapor, and after compressed in the axial flow compressor 10 according to the embodiment, the water vapor as the working fluid becomes, for example, 150° C. or below under an atmospheric pressure or below at the discharge opening of the axial flow compressor 10. Through the refrigerant circuit 14, the working fluid compressed in the axial flow compressor 10 is sent to the condenser 13 and condensed there. In this way, the working fluid undergoes phase changes and circulates through the refrigerant circuit 14. The evaporator 12 evaporates the refrigerant and thereby supplies a secondary heating medium with cold heat, and the secondary heating medium is supplied to a user unit (not shown) cooling an object to be cooled such as room air.

The axial flow compressor 10 includes a compression portion 20 having a compression space CS for compressing a working fluid, an electric motor 22 driving the compression portion 20, and a velocity reducing portion 24 reducing the flow velocity of the working fluid discharged from the compression space CS. The axial flow compressor 10 includes a casing 26 formed by: a first case portion 27 arranged in the compression portion 20 and having a cylindrical shape; a second case portion 28 arranged on one end side (upstream side) of the compression portion 20; and a third case portion 29 arranged in the velocity reducing portion 24 on the other end side (downstream side) of the compression portion 20.

The compression portion 20 includes the first case portion 27 and a rotor 31 inside of the first case portion 27. The space between the first case portion 27 and the rotor 31 functions as the compression space CS for compressing a working fluid. The compression space CS includes a suction opening CS1 on the left and a discharge opening CS2 on the right of FIG. 1. Through the suction opening CS1 on the left, the working fluid evaporated in the evaporator 12 is sucked into the compression space CS, compressed as it goes to the right and discharged from the discharge opening CS2.

On the inner circumferential surface of the first case portion 27, a plurality of stationary vanes 33 are fixed apart from each other in the axial directions. The first case portion 27 is set in such a way that the axial directions are horizontal.

The rotor 31 includes a plurality of rotor vanes 34 apart from each other in the axial directions and alternate with the stationary vanes 33, and a plurality of spacers 35. Each spacer 35 is a cylindrical member and arranged inside in the radial directions of the corresponding stationary vane 33 and between the corresponding adjacent rotor vanes 34. FIG. 1 shows the four rotor vanes 34 and the four spacers 35, but the present invention is not limited to this configuration.

The rotor vane 34 includes a cylindrical boss portion 37 and a vane portion 38 around and united with the boss portion 37. As described later, the rotor vane 34 is made of aluminum or aluminum alloy and a unit formed by cutting a single blank. The boss portion 37 is formed in the peripheral directions with a plurality of the vane portions 38 and has outer and inner circumferential surfaces flush with those of the spacers 35.

The compression portion 20 includes a driving shaft 40, a first pressing member 41, a second pressing member 42, a nut 43 as an example of the fixing portion, and a disk member 44. The driving shaft 40 includes a rotor shaft portion 46 and an end shaft portion 47, 47 arranged at each end of the rotor shaft portion 46.

The rotor shaft portion 46 is on the axial center of the first case portion 27 and extends in the axial directions thereof. Both ends of the rotor shaft portion 46 are outside of the rotor vanes 34 and the spacers 35 in the axial directions and are provided with an external thread portion (not shown).

The first pressing member 41 is arranged in contact with the most upstream rotor vane 34 while the second pressing member 42 is arranged in contact with the spacer 35 outside of the most downstream rotor vane 34. The first and second pressing members 41 and 42 are arranged opposite in the axial directions, even though having the same configuration.

The first pressing member 41 has a disk shape and the pressing member 41 is formed with a central through hole for inserting the rotor shaft portion 46. The first pressing member 41 is fitted to the rotor vane 34, and thereby, the axial center of the first pressing member 41 coincides with the axial center of the most upstream rotor vane 34. Using bolts, the end shaft portion (first end shaft portion) 47 is fixed to the first pressing member 41, and thereby, the end shaft portion 47 and the first pressing member 41 become coaxial with each other.

The second pressing member 42 is fitted to the spacer 35 outside of the most downstream rotor vane 34, and thereby, the axial center of the second pressing member 42 coincides with the axial center of the most downstream spacer 35. Using bolts, the end shaft portion (second end shaft portion) 47 is fixed to the second pressing member 42, and thereby, the end shaft portion 47 and the second pressing member 42 become coaxial with each other.

In terms of the first and second pressing members 41 and 42, the nut 43 is screwed onto the external thread portion of the rotor shaft portion 46 inserted through the central through hole. In this manner, the first pressing member 41 and the second pressing member 42 are fastened with the nuts 43 from both sides in the axial directions with holding the rotor 31 (the rotor vanes 34 and the spacers 35) between the pressing members 41 and 42. The nut 43 is tightened up by a predetermined torque value to thereby fasten the first pressing member 41 and the second pressing member 42. The "predetermined torque value" is set, as described later, taking into account the fact that the difference in linear expansion coefficient between the rotor 31 and the rotor shaft portion 46 or the difference in expansion volume between both in operation makes the coupling force of the nut 43 greater in operation than when the rotor 31 is assembled. Therefore, the rotor vanes 34 adjacent to each other and spacer 35 are fitted to each other.

The spacer 35 and the boss portion 37 have an inner diameter far larger than the outer diameter of the rotor shaft portion 46. Between the cylindrical part formed by the connected spacer 35 and boss portion 37 and the rotor shaft portion 46, therefore, a space extending in the axial directions is formed, and a disk member 44 is provided in this space or an inner space 31*a* of the rotor 31. The spacer 35 is formed with a concave portion having a width corresponding to the thickness of the disk member 44. The periphery of the disk member 44 is inserted into the concave portion, and in this state, the disk member 44 is fastened onto the spacer 35 with a bolt. In other words, the disk member 44 is sandwiched with no gap between the boss portion 37 of the rotor vane 34 and the spacer 35.

The disk member 44 is perpendicularly postured to the rotor shaft portion 46 and formed at the center with a through hole penetrating in the thickness directions. The rotor shaft portion 46 is inserted in the through hole and thereby supported with each disk member 44 at a plurality of places in the middle thereof.

The rotor vanes 34 are all made of aluminum or aluminum alloy and the spacers 35 are all made of aluminum or aluminum alloy; in other words, the rotor 31 is made of aluminum or aluminum alloy. On the other hand, the rotor shaft portion 46 is made of titanium or titanium alloy which is a material having a lower linear expansion coefficient than that of aluminum. Therefore, the axial flow compressor 10 generates heat in operation to thereby expand the rotor 31 by more volume than the rotor shaft portion 46 in the axial directions.

The first pressing member 41 and the second pressing member 42 are made of stainless steel or stainless alloy, and the disk member 44 is made of aluminum or aluminum alloy.

In the embodiment, the rotor vanes 34 including the most upstream rotor vane 34 are made of aluminum or aluminum alloy. At least the most upstream rotor vane 34 may be subjected to anodic coating, thereby effectively preventing the rotor vanes 34 from being eroded while lightening the rotor vanes 34. Further, the most upstream rotor vane 34 may be made of titanium, titanium alloy, stainless steel or stainless alloy, thereby preventing the most upstream rotor vane 34 from being eroded and simultaneously making it more durable.

As shown in FIG. 1, the end shaft portion 47, 47 at each end is supported with a bearing 55, 55 and is coaxial with the rotor shaft portion 46. The bearing 55 supports the end shaft portion 47 at a main portion 47*c* thereof with the end shaft portion 47 rotatable. The main portion 47*c* extends coaxially with the rotor shaft portion 46.

Both bearings 55 and 55 are placed in an upstream housing 56 at one end and a downstream housing 57 at the other end, respectively. The upstream housing 56 and the second case portion 28 form a cylindrical space therebetween and this space becomes an upstream space US for flowing the working fluid led into the compression space CS. On the other hand, the downstream housing 57 and the third case portion 29 form a cylindrical space therebetween and this space becomes a downstream space DS for flowing the working fluid led from the compression space CS.

Each housing 56, 57 is supported to the second case portion 28 or the third case portion 29 via a plurality of support members 59, 59 each having a rod shape and arranged radially in the circumferential directions. Each support member 59, 59 has a streamline shape in section and thereby does not block a flow of a working fluid even in the upstream space US and the downstream space DS. The FIGURE shows an example where the support member 59 comes into the housing 57 in the downstream space DS, but this part coming into the housing 57 not necessarily has a rod shape.

The support member 59 is formed with supply-and-discharge passages 59*a* for supplying and discharging a lubricant. The lubricant is introduced from outside of the second case portion 28 and the third case portion 29, fed through one supply-and-discharge passage 59*a* to the bearing 55 and discharged through the other supply-and-discharge passage 59*a* from the bearing 55.

The end shaft portion 47 on the discharge opening CS2 side is inside of the downstream housing 57 and connected to a rotating shaft 22*a* of the electric motor 22 via a flexible coupling 61 as an example of the vibration damping portion. The driving shaft 40 of the compression portion 20 is connected without any speed-up gear to the rotating shaft 22*a* of the electric motor 22 and thereby the rotor 31 has the same rotational speed as that of the electric motor 22.

The above described velocity reducing portion 24 has the downstream space DS formed with the third case portion 29. The third case portion 29 has an outer circumferential surface portion 29*a* connected to an end of the first case portion 27 in the axial directions, an inner circumferential surface portion 29*b* inward from the outer circumferential surface portion 29*a* and extending in the axial directions, an end surface portion 29*c* connecting ends of the outer circumferential surface portion 29*a* and the inner circumferential surface portion 29*b* in the axial directions.

The outer circumferential surface portion 29*a*, shaped like a cylinder, is formed midway in the axial directions with a flare portion 29*d* whose inner diameter gradually enlarges as it goes away from the discharge opening CS2. The outer circumferential surface portion 29*a* is formed with a portion 29*e* having a fixed inner diameter ahead of the flare portion 29*d*. On the other hand, the inner circumferential surface portion 29*b* is connected to an end of the downstream housing 57 and shaped like a cylinder having a fixed outer diameter in the axial directions. Hence, the downstream space DS has: a taper part which has a ring shape in a perpendicular section to the axial directions and whose sectional area enlarges gradually; and a parallel part which has a ring shape in a perpendicular section to the axial directions and whose sectional area is unchanged.

At least the taper part functions as a diffuser which reduces the flow velocity of a working fluid compressed in the compression portion 20 and thereby recovers the pressure thereof, while the parallel part functions as a collector collecting the fluid whose flow velocity has been reduced in the taper part. In the velocity reducing portion 24, the working fluid is sufficiently decelerated at the taper part and thereby recovers the pressure without an excessive loss at the parallel part. In the FIGURE, the inner circumferential surface portion 29*b* is connected stepwise to the housing 57, but it may be connected without any step. Further, the inner circumferential surface portion 29*b* may be tapered at a part thereof corresponding to the taper part of the outer circumferential surface portion 29*a*. Still further, the length or the like of the parallel part can be suitably selected in accordance with how much the flow velocity of a working fluid discharged from the discharge opening CS2 should be reduced.

The outer circumferential surface portion 29*a* is formed at the portion 29*e* forming the parallel part with an outlet port 65 connected to piping for leading, to the condenser 13, a working fluid whose flow velocity is reduced inside of the downstream space DS.

The inner circumferential surface portion 29*b* is formed with a motor support portion 66 extending inward in the radial directions from the connection part thereof to the housing 57. The electric motor 22 is placed inward from the inner circumferential surface portion 29*b* of the velocity reducing portion 24 and attached to the motor support portion 66.

In the axial flow compressor 10 according to the embodiment, as the rotating shaft 22*a* of the electric motor 22 rotates, the driving shaft 40 of the compression portion 20 rotates at the same rotational speed to rotate the rotor 31 around the axis thereof. This rotation causes a working fluid inside of the upstream space US to be sucked through the suction opening CS1 into the compression space CS, compressed and sent to the right of FIG. 1 in the compression space CS and discharged through the discharge opening CS2 to the downstream space DS. In the velocity reducing portion 24, the flow velocity of the working fluid is reduced and the pressure thereof recovered, and then, it is discharged through the outlet port 65.

As described so far, the axial flow compressor 10 according to the embodiment is configured in such a way that the driving shaft 40 of the compression portion 20 is connected without a speed-up gear to the rotating shaft 22*a* of the electric motor 22. Hence, there is no need to arrange the electric motor 22 with displaced in the diametrical directions from the compression portion 20, thereby preventing an increase in the width of the compression portion 20 as the axial flow compressor 10 in the diametrical directions. Besides, the fact that no speed-up gear is provided also prevents an increase in the width of the compression portion 20 in the diametrical directions. Furthermore, the velocity reducing portion 24 extends in the axial direction of the driving shaft 40 around the electric motor 22, thereby securing the volume of a space in the velocity reducing portion 24 or the volume of a space for reducing the flow velocity of the working fluid and preventing an increase in the width of the axial flow compressor 10 in the diametrical directions. Particularly, the axial flow compressor 10 according to the embodiment is used for compressing water vapor having a temperature in the range of e.g. from 5° C. to 150° C. under an atmospheric pressure or below in a region from a suction opening to a discharge opening of the axial flow compressor 10, and the axial flow compressor 10 is provided with plural stages of rotor vanes e.g. seven stages of rotor vanes, in the range from e.g. 5° C. to 250° C. and hence the low-power electric motor 22 is available, thereby also preventing an increase in the width of the compression portion 20 in the diametrical directions. Moreover, the axial flow compressor 10 is configured in such a way that a working fluid is discharged in the axial directions and the velocity reducing portion 24 extends in those directions, and thereby, the pressure thereof can be more efficiently recovered than when the velocity reducing portion is bent in the radial directions.

In addition, in the embodiment, the driving shaft 40 of the compression portion 20 and the rotating shaft 22*a* of the electric motor 22 connect by the flexible coupling 61, thereby suppressing the transmission of a vibration of the rotating shaft 22*a* to the driving shaft 40 of the compression portion 20 even if the electric motor 22 is driven at a high rotational speed.

The present invention is not limited to the above embodiment, and hence, various changes, modifications and the like can be expected without departing from the scope of the present invention. For example, the embodiment shows the axial flow compressor 10 used for a refrigerator, but the present invention is not limited to this example. For example, the axial flow compressor 10 may be configured, for example, as a compressor used for a chiller for obtaining cooling water, an air conditioner, a concentrator or the like.

The working fluid is not limited to water vapor, and for example, a variety of fluids such as air, oxygen, nitrogen and a hydrocarbon process gas can be used.

Furthermore, in the embodiment, the rotor 31 has a plurality of the rotor vanes 34 but the present invention is not limited to this, and hence, the rotor 31 may have the single rotor vane 34.

Moreover, in the embodiment, the rotating shaft 22*a* of the electric motor 22 and the driving shaft 40 of the compression portion 20 connect by the flexible coupling 61, but the present invention is not limited to this configuration. For example, the driving shaft 40 and the rotating shaft 22*a* may connect by an intermediate shaft (not shown) provided with a bearing. The intermediate shaft suppresses the transmission of a vibration of the rotating shaft 22*a* to the driving shaft 40 and hence functions as the vibration damping portion.

In addition, in the embodiment, the rotating shaft 22*a* of the electric motor 22 and the driving shaft 40 of the compression portion 20 connect by the vibration damping portion. However, suitably depending upon the rotational speed or the like of the electric motor 22, the vibration damping portion may be omitted to thereby directly connect the driving shaft 40 and the rotating shaft 22*a*.

An outline of the above embodiment will be described below.

The axial flow compressor according to the above embodiment is configured in such a way that the driving shaft of the compression portion is connected without a speed-up gear to the rotating shaft of the electric motor. Hence, there is no need to arrange the electric motor with displaced in the diametrical directions from the compression portion, thereby preventing an increase in the width of the compression portion as the axial flow compressor in the diametrical directions. Besides, the fact that no speed-up gear is provided also prevents an increase in the width of the compression portion in the diametrical directions.

The velocity reducing portion may extend beyond the electric motor in the axial direction of the driving shaft. According to this aspect, the velocity reducing portion extends in the axial direction of the driving shaft around the electric motor, thereby securing the volume of a space in the velocity reducing portion or the volume of a space for reducing the flow velocity of the working fluid and preventing an increase in the width of the axial flow compressor in the diametrical directions.

The driving shaft of the compression portion and the rotating shaft of the electric motor may be connected by a vibration damping portion. According to this aspect, even if the electric motor is driven at a high rotational speed, the transmission of a vibration of the rotating shaft to the driving shaft of the compression portion can be suppressed.

As described above, the axial flow compressor according to the above embodiment is capable of reducing the flow velocity of a working fluid discharged from a compression portion to a predetermined value and being miniaturized.

EXPLANATION OF CODES

20: compression portion
22: electric motor
22*a*: rotating shaft
24: velocity reducing portion
31: rotor
34: rotor vane
61: flexible coupling

What is claimed is:

1. An axial flow compressor for compressing a working fluid, comprising:

an electric motor including a rotating shaft;

a compression portion including a driving shaft connected without a speed-up gear to the rotating shaft of the electric motor and a rotor rotating together with the driving shaft, the compression portion driving the driving shaft and thereby compressing a working fluid; and a velocity reducing portion having a space for reducing a flow velocity of a working fluid discharged from a discharge opening of the compression portion, wherein:

the rotating shaft of the electric motor is connected to an end of the driving shaft on the side of the discharge opening; and the velocity reducing portion is disposed so as to surround the electric motor.

2. The axial flow compressor according to claim 1, wherein the velocity reducing portion extends beyond the electric motor in the axial direction of the driving shaft.

3. The axial flow compressor according to claim 1, wherein the driving shaft of the compression portion and the rotating shaft of the electric motor are connected by a vibration damping portion.

4. The axial flow compressor according to claim 2, wherein the driving shaft of the compression portion and the rotating shaft of the electric motor are connected by a vibration damping portion.

* * * * *